United States Patent [19]

Wilson

[11] 4,184,685

[45] Jan. 22, 1980

[54] THREE-DIMENSIONAL GAME APPARATUS

[76] Inventor: David A. D. J. Wilson, 2126 E. 93rd St., Suite #6, Cleveland, Ohio 44106

[21] Appl. No.: 879,729

[22] Filed: Feb. 21, 1978

[51] Int. Cl.[2] ..... A63F 3/00

[52] U.S. Cl. ..... 273/241; 273/258

[58] Field of Search ..... 273/258, 241

[56] References Cited

U.S. PATENT DOCUMENTS

| | | | |
|---|---|---|---|
| D. 245,192 | 7/1977 | Davis | 273/241 |
| 3,065,969 | 11/1962 | Jennens | 273/258 |
| 3,656,755 | 4/1972 | Thompson | 273/241 |
| 3,661,391 | 5/1972 | Henshaw | 273/241 |

OTHER PUBLICATIONS

Gardner, M.; *Mathematical Games;* in *Scientific American,* 9/1971, pp. 104–107.

*Primary Examiner*—Richard C. Pinkham
*Assistant Examiner*—R. Carl Moy
*Attorney, Agent, or Firm*—Meyer, Tilberry & Body

[57] ABSTRACT

A three dimensional game is provided comprising upper and lower playing fields each divided into corresponding first and second playing areas. Each playing area is provided with the same number of game piece locations, and the upper and lower playing fields are oriented for the first and second playing areas on the upper field to respectively overlie the second and first playing areas on the lower field. Two sets of game pieces are provided each of a number corresponding to the number of game piece locations provided in the two playing areas of one of the playing fields. The game is played by initially placing all of the game pieces in the corresponding one of the two playing areas in the upper field, thus completely filling the corresponding playing area. The players then, in sequential turn, move their respective game pieces into the corresponding playing area of the lower playing field other than by direct movements thereinto from the corresponding upper playing area.

10 Claims, 5 Drawing Figures

FIG. 2
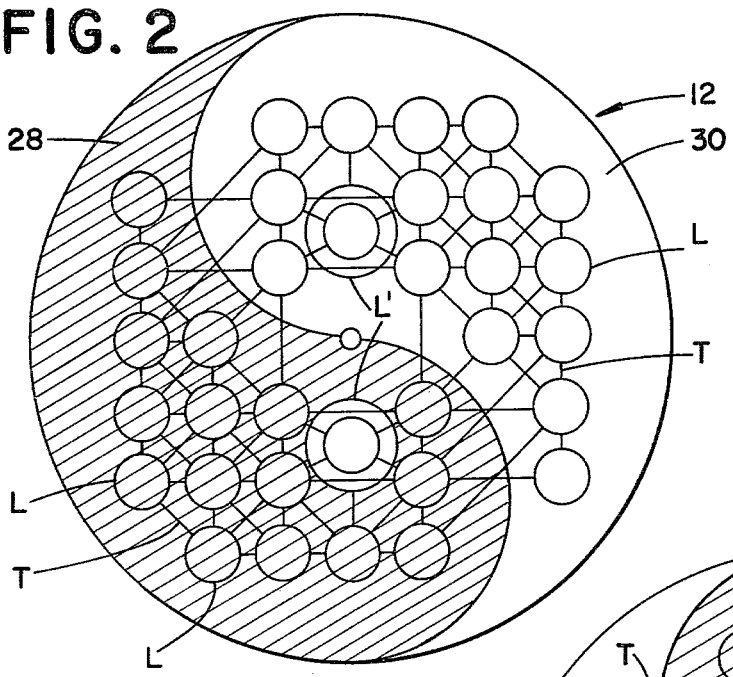
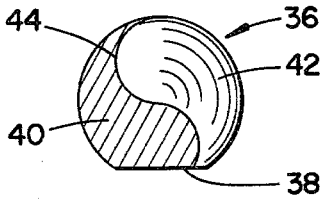
FIG. 4
FIG. 3
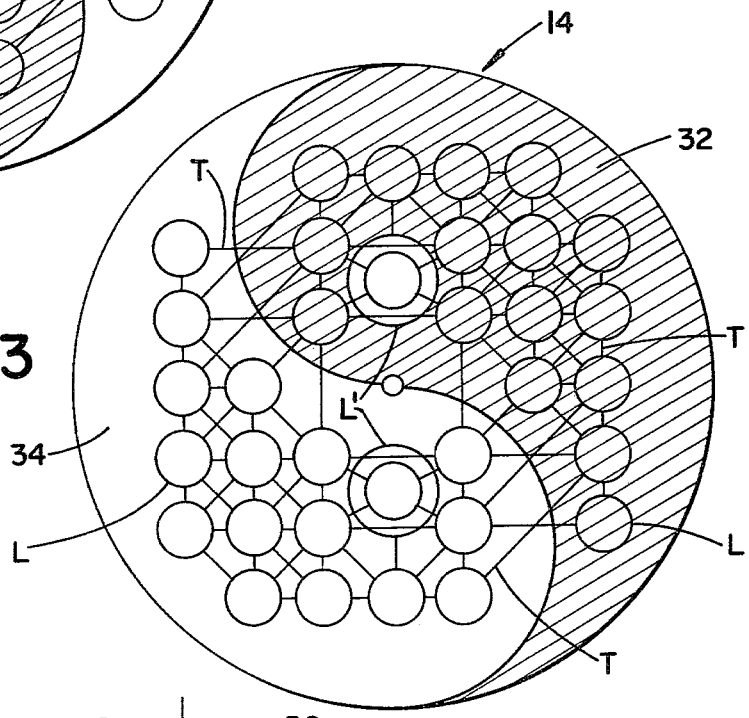
FIG. 5
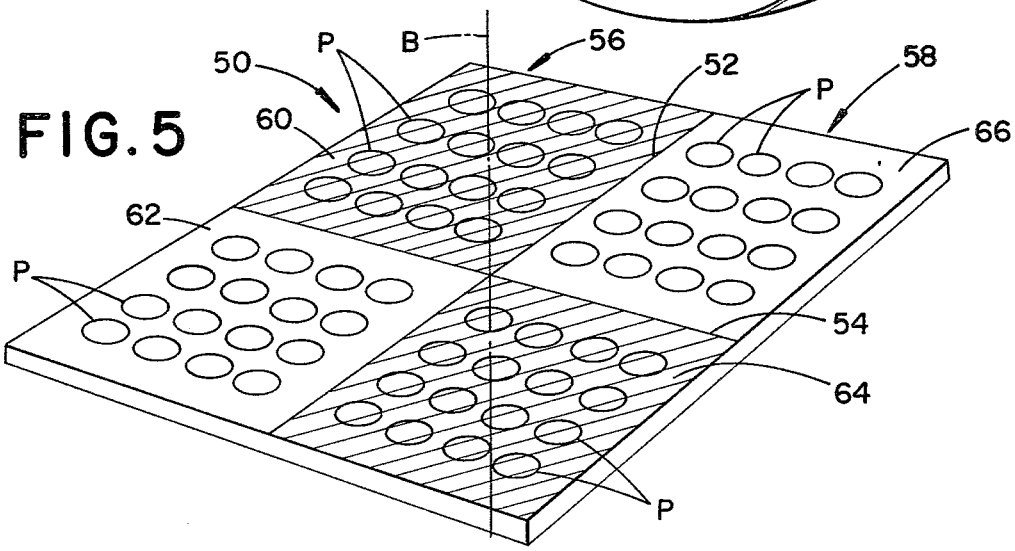

THREE-DIMENSIONAL GAME APPARATUS

This invention relates to the art of games and, more particularly, to a game board and game piece combination providing a game of mental challenge.

Numerous games have been provided heretofore requiring considerable concentration on the part of the players in moving game pieces relative to one another and relative to an opponent's game pieces on a game board. Chess, Checkers and Chinese Checkers are among the better known games of this type. In certain instances, such as with Chess for example, three dimensional varities have been provided to increase the mental challenge and intrigue in playing the games. In the game of Chess, the object is to manoeuvre game pieces, capture opponent's game pieces, and ultimately in effect capture the opponent's king. Somewhat similarly, in the game of Checkers the objective is to capture or eliminate all of the opponent's game pieces. In the game of Chinese Checkers the objective is to advance game pieces through a neutral zone from a starting area to a home area without capturing opponent's game pieces. Rather, the player's game pieces as well as those of his opponent are used to enable jumps for advancing game pieces toward the home location.

In all of the above games, the mental challenge comes from the players anticipating his own moves as well as those of his opponent in an effort to out-play the opponent and win the game. The game provided in accordance with the present invention provides such a mental challenge, differing from Chess and Checkers in that there is no elimination of game pieces, and differing from Chinese Checkers in that there is no neutral field into which the game pieces of both players are moved and from which the game pieces of both players are ultimately removed in completing the game.

More particularly, the game according to the present invention is provided with just four playing areas in corresponding pairs denoting a starting and home area for each of two players. Each of the four playing areas has a like number of game piece locations or playing spaces thereon, and each player has game pieces corresponding in number with the number of playing spaces in one playing area. Accordingly, at the beginning of the game the starting area of each of the players is completely filled, leaving just the home playing areas into which the game pieces can be moved. In playing the game, a player cannot move one of his game pieces from his starting area directly to his home area, but rather must go through either his opponent's starting area or his opponent's home area, and thence into his own home area. Moves are made by the players between adjacent playing spaces and/or by jumping manoeuvers during the course of the game. The intrigue and mental challenge will be appreciated from the fact that the total number of unoccupied playing spaces available at any time for manoeuvering is equal to the total number of game pieces of both players. Additionally, each player has to manoeuver his game pieces from his starting area through his opponent's starting area, which will be occupied during initial stages of the game by his opponent's game pieces, and through his opponent's home area which at sometime during the game will be occupied by his opponent's game pieces. Still further, each player has to then manoeuver his game pieces into his own home area which may be at least partially occupied by his opponent's game pieces. In other words, there is no neutral zone or area of manoeuvering available to the players and, accordingly, the available moves are limited and mental concentration is required to develop strategy in connection with manoeuvering the game pieces.

In accordance with a preferred embodiment of the invention, a two level game board is provided having the starting areas for the two players on one level and the home areas on the other level. Preferably, the two levels are defined by circular discs coaxially arranged in spaced apart relationship and each divided into two playing areas, and the discs are oriented for the starting area of each player to overlie his opponent's home area. Thus, a player's starting and home areas are on two levels and are in diametrically opposed relationship.

It is an outstanding object of the present invention to provide a game which is mentally challenging and which offers through degrees of concentration the ability to establish strategies for game piece movement.

Another object is the provision of a game board and game piece combination providing a game involving movement of a given number of game pieces from one playing area to another and in which the total number of unoccupied spaces for game piece movement available at any time is equal to the total number of game pieces.

A further object is the provision of a game of the foregoing character in which the game board and game piece combination provides a given total number of playing spaces and two sets of game pieces of equal number and totaling one-half the total number of playing spaces.

Still another object is the provision of a game of the foregoing character wherein the game board is comprised of just four playing areas in corresponding pairs, each of which playing areas has the same number of playing spaces therein, and two sets of game pieces each of a number corresponding to the number of playing spaces in one playing area.

Still another object is the provision of a game of the foregoing character in which the four playing areas are on two different levels and are relatively oriented for each corresponding pair of playing areas to be on the two levels and in diametrically opposed relationship.

The foregoing objects, and others, will in part be obvious and in part pointed out more fully hereinafter in conjunction with the written description of preferred embodiments of the game illustrated in the accompanying drawings in which:

FIG. 2 is a plan view of the upper playing field of the game board shown in FIG. 1;

FIG. 3 is a plan view of the lower playing field of the game board shown in FIG. 1;

FIG. 4 is an elevation view of one of the game pieces shown in FIG. 1; and, FIG. 5 is a perspective view of a modified game board arrangement in accordance with the present invention.

Figure 1:
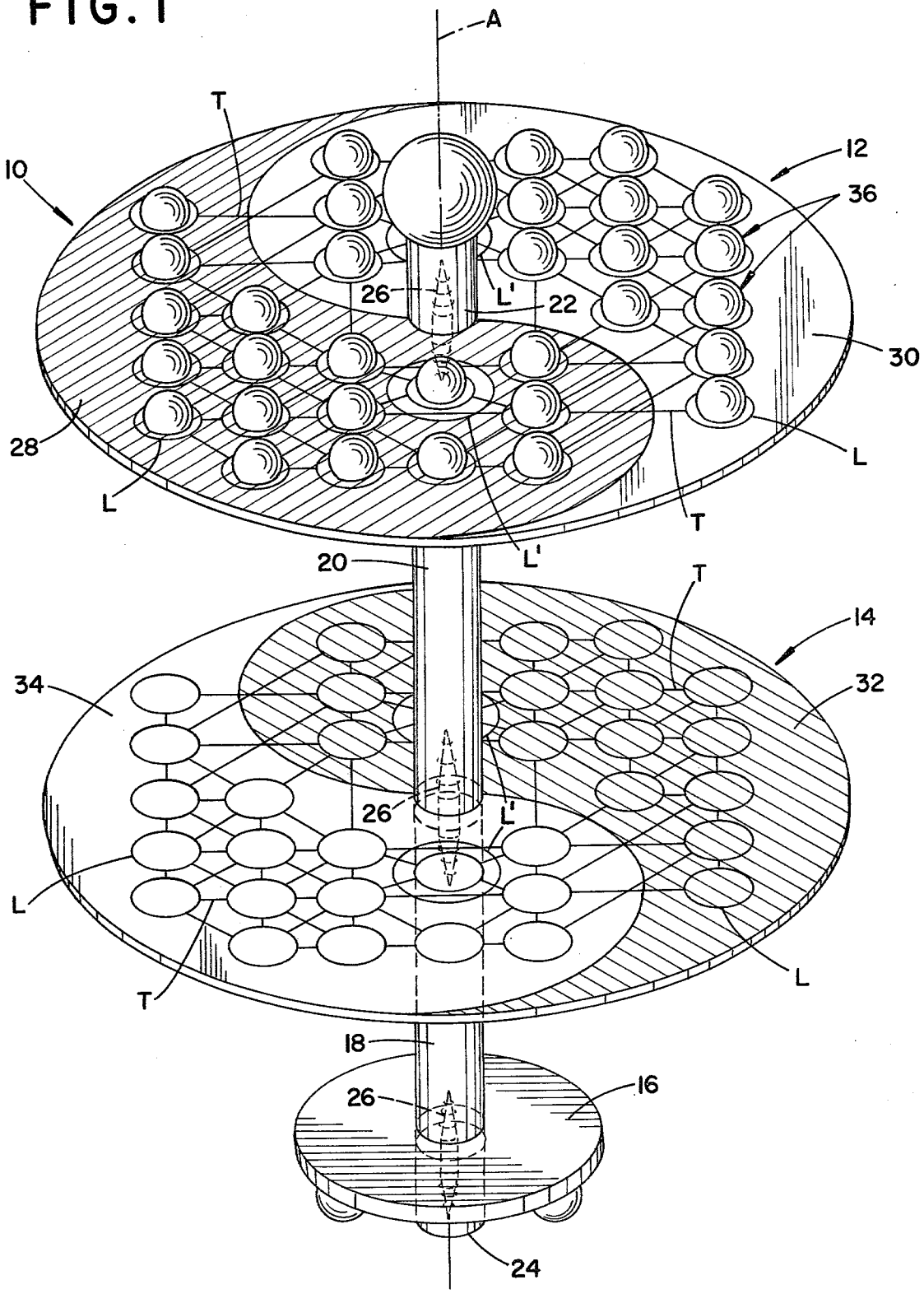
FIG. 1 is a perspective view of a three dimensional game board and game piece combination in accordance with the present invention.

Referring now in greater detail to the drawings wherein the showings are for the purpose of illustrating preferred embodiments of the invention only and not for the purpose of limiting the invention, a game board assembly 10 is shown in FIG. 1 which includes upper and lower circular game board discs 12 and 14, respectively, of plastic or other suitable material. In the embodiment shown, game board discs 12 and 14 are supported in coaxial, parallel spaced apart relationship by means of a support stand assembly which enables the game to be dismantled for storage purposes. In this repect, the stand assembly includes a base disc 16, a support post 18 between disc 16 and game board disc 14, a support post 20 between game board discs 12 and 14, and upper and lower capping members 22 and 24, respectively. Game board discs 12 and 14 and base disc 16 are centrally apertured to freely receive threaded studs 26 which enable threaded interengagement of support posts 18 and 20 with game board disc 14 therebetween, threaded interengagement of post 20 and capping member 22 with game board disc 12 therebetween, and threaded interengagement of support post 18 and capping member 24 with base disc 16 therebetween.

As seen in FIGS. 1–3, each of the game board discs 12 and 14 provides a playing field divided symmetrically so as to provide upper disc 12 with visually distinguishable first and second playing areas 28 and 30 and to provide lower disc 14 with visually distinguishable playing areas 32 and 34. Visual distinction between the playing areas on each of the discs can be achieved in any suitable manner such as by providing for the two playing areas to be of different color. Further, the first playing areas of each disc provide the starting and home playing areas for one player and the second playing areas of each disc provide the starting and home playing areas for a second player. Accordingly, if the first and second playing areas 28 and 30 of upper disc 12 were respectively red and green for example, the corresponding first and second areas 32 and 34 of lower disc 14 would respectively be red and green. It will be appreciated, however, that such coloring is just one convenient way of distinguishing the respective player's playing areas and that such distinction can be achieved in any desired manner. In the preferred embodiment, such color combinations are employed to divide each of the game board discs into two playing areas and, for aesthetic purposes as set forth more finally hereinafter, the division of each disc is in the form of a S-curve which provides for each playing area to be of teardrop configuration.

Each of the playing areas 28, 30, 32 and 34 is provided with a like number of circular game piece locations or playing spaces L. One of the game piece locations in each of the four playing areas, designated L′, is diametrically larger than the others and contrasted with respect thereto, such as by color, again for aesthetic purposes. Playing spaces L and L′ are in like positions in each of the playing areas, and are connected within the playing area and across the division line between playing areas on each disc by transistion lines T. Transition lines T designate directional control for movements of game pieces between spaces L and L′ within the corresponding playing area and across the division line to the adjacent playing area.

With regard to the aesthetics of the game board discs referred to above, game board discs 12 and 14 are divided by S-curves and color contrasted as shown and mentioned above, and the enlarged and color contrasted playing space L′ is positioned as shown in the corresponding teardrop to provides for each disc to be in the form of a sign representing Yin and Yang, an ancient oriental philosophy. The enlarged game piece location L′ forms the eye of the oriental sign and, in connection with the game of the present invention, can be employed for special purposes in connection with movement of game pieces during playing of the game.

As will be appreciated from FIG. 1, the axis A of upper and lower game board discs 12 and 14 is a reference axis for the game board discs. It will be further appreciated that the discs are oriented relative to axis A for the first and second playing areas of one disc to be circumferentially offset relative to the corresponding first and second playing areas of the other disc. Preferably, as shown in FIG. 1, the discs are oriented for the corresponding playing areas to be in diametrically opposite positions relative to axis A. Accordingly, first playing area 28 of upper disc 12 directly overlies second playing area 34 of lower disc 14, and second playing area 30 of upper disc 12 directly overlies first playing area 32 of lower disc 14.

The game according to the present invention further includes two sets of game pieces, the game pieces in each set being alike and the game pieces in the two sets being visually distinguishable from one another. Each set of game pieces is of a number corresponding to the number of playing spaces in one playing area of one of the game board discs. In the embodiment shown, there are seventeen playing spaced L and L′ in each of the four playing areas 28, 30, 32 and 34. Accordingly, each of the two sets of game pieces in this embodiment would include seventeen game pieces. The game pieces may take a variety of forms and shapes, such as balls, discs and the like, and the game pieces of the two sets can be made visually distinguishable in a number of ways including shape, color and the like. A suitable game piece configuration is shown in FIG. 4 and is in the form of a sphere or ball 36 provided on its bottom with a flat 38 enabling the game piece to rest stably on the game board discs. In connection with the aesthetics of the embodiment herein disclosed, each game piece is provided with areas 40 and 42 of different shades of the same color separated along an S-shaped line 44 in keeping with the oriental Yin Yang sign mentioned above. In connection with the red and green colors of the playing areas mentioned hereinabove, one set of the game pieces would be colored with two shades of red and the other set of game pieces would be colored with two shades of green, thus to visually distinguish the game pieces of the two sets.

In playing the game, with respect to the embodiment described hereinabove, one or the other of the upper and lower game board discs 12 and 14 would be employed as the starting playing areas for the two players, whereby each player would place his game pieces in covering relationship with respect to the playing spaces in his starting area. Assuming that upper disc 12 is chosen in this respect, the game would be set up as shown in FIG. 1. One of the players is designated to be first, and this player's initial move must be from his starting area into the home area of his opponent on the lower game board disc in that all of the playing spaces on the upper disc are filled at the start of the game. Thus, for example, if the player starting the game occupies playing area 28 as his starting area, he would move one of his game pieces down to the home area of his opponent on lower disc 14, which home area is the second playing area 34 on the lower disc. The ultimate goal of such first player is to move all of his game pieces into his home area on lower disc 14, namely first playing area 32 of the lower disc. He can proceed in this direction by moves downwardly in the manner of the first move once he works a given game piece to the periphery of the upper disc along the transition lines. He can also reach his home area by movements across upper disc 12 into his opponent's starting area 30 along the transition lines, and when spaces are available in area 30, and thence to the periphery of the upper disc and downwardly into his home area. Accordingly, it will be appreciated that concentration and strategy play an important part in the game.

Referring now to FIG. 5 of the drawing, there is illustrated a modification of the game board of the present invention. In this respect, a planar game board 50 is illustrated which is of rectangular configuration and divided into quadrants by means of lines 52 and 54. Line 52 divides the game board into playing fields 56 and 58. Line 54 divides playing field 56 into first and second playing areas 60 and 62, respectively, and divides playing field 58 into first and second playing areas 64 and 66, respectively. First playing areas 60 and 64 of the two playing fields are laterally opposite one another with respect to a reference axis B perpendicular to the game board, and second playing surfaces 62 and 66 are likewise laterally opposite one another with respect to the reference axis. Each of the playing areas 60, 62, 64 and 66 is provided with an equal number of playing spaces P. It will be appreciated from the foregoing description of the preferred embodiment that two sets of game pieces, not shown, will be provided and each set will include a number of game pieces equal to the number of playing spaces P in one of the four playing areas. It will be further appreciated that the planar game board could be defined by four individual game board pieces positioned as shown as well as a one piece game board. Alternatively, the game board could be comprised of panels suitably interrelated for folding relative to one another.

From the foregoing description of the preferred embodiment, it will be appreciated that the game is played on the game board 50 by each player initially positioning his game pieces on the playing spaces in one of the playing areas of one of the playing fields. The initial play of the first player would be laterally of his starting area into the home area of his opponent, and during progress of the game the first player will move his game pieces through his opponents home area into his own home area and/or through his opponent's starting area and thence into his own home area.

While considerable emphasis has been placed on the embodiments of the invention herein illustrated and described, it will be appreciated that many changes in the preferred structures of the game board and arrangements of the playing areas can be made without departing from the principles of the present invention. It is important in connection with the game of the present invention, however, that there are just four playing areas in corresponding pairs, that each playing area have the same number of playing spaces therein, and that there are two sets of game pieces each including a number of game pieces corresponding to the number of playing spaces in one playing area. Accordingly, with the exception of the latter limitations, it is to be distinctly understood that the foregoing descriptive matter is to be interpreted merely as illustrative of the present invention and not as a limitation.

Having thus defined the invention, it is claimed:

1. Game apparatus comprising, game board means providing just four planar playing areas, a first two of said playing areas being alike in appearance, the second two of said playing areas being alike in appearance and distinct in appearance from said first two of said playing areas, said alike ones of said four playing areas being in circumferentially spaced relationship with respect to each other relative to a reference axis perpendicular to the planes thereof, an equal number of playing spaces in each of said four playing areas, and first and second sets of game pieces each of a total number corresponding to the number of playing spaces in one of said four playing areas, said four playing areas providing the only playing spaces for said game pieces on said game board means, and said alike playing areas being in planes axially spaced apart with respect to said reference axis.

2. Game apparatus according to claim 1, wherein one playing area of each of said alike playing areas are coplanar.

3. Game apparatus according to claim 2, wherein said coplanar playing areas are on laterally opposite sides of said reference axis.

4. Game apparatus according to claim 2, wherein said alike playing areas are on laterally opposite sides of said reference axis.

5. Game apparatus according to claim 4, wherein said coplanar playing areas are on laterally opposite sides of said reference axis.

6. Game apparatus comprising, game board means providing just first and second planar playing fields, means dividing each of said playing fields into just two visually distinct and separate first and second playing areas, each of said first and second playing areas of one of said first and second playing fields being circumferentially offset relative to the corresponding one of said first and second playing areas of the other of said first and second playing fields with respect to a reference axis perpendicular to the planes of said playing fields, an equal number of playing spaces in each of said first and second playing areas of each of said first and second playing fields, and first and second sets of game pieces each set of a number corresponding to said number of playing spaces in one of said first and second playing areas of one of said first and second playing fields, said first and second playing areas providing the only playing spaces for said game pieces on said game board means, said game board means including means supporting said first and second playing fields in parallel spaced apart relationship.

7. Game apparatus according to claim 6, wherein each of said first and second playing areas of said one playing field is laterally opposite the corresponding one of said first and second playing areas of said other playing field.

8. Game apparatus according to claim 7, wherein said first and second playing fields are oriented relative to said reference axis for said first and second playing areas of said one playing field to respectively axially overlie said second and first playing areas of said other playing field.

9. Game apparatus according to claim 6, wherein each of said first and second playing fields is a circular disc and said game board means includes means supporting said first and second playing fields in coaxial spaced apart relationship, the axes of said discs defining said reference axis.

10. Game apparatus according to claim 9, wherein said first and second playing fields are oriented relative to said reference axis for said first and second playing areas of said one playing field to respectively axially overlie said second and first playing areas of said other playing field.

* * * * *